United States Patent [19]

Pozniko

[11] 3,983,949

[45] Oct. 5, 1976

[54] AUGER SECTION POSITIONING MEANS

[75] Inventor: John M. Pozniko, Salem, Ohio

[73] Assignee: The Salem Tool Company, Salem, Ohio

[22] Filed: Nov. 5, 1975

[21] Appl. No.: 629,026

[52] U.S. Cl. ..... 175/85; 175/91

[51] Int. Cl.[2] ..... E21B 19/14; E21C 27/22

[58] Field of Search ..... 175/52, 85, 91; 214/2.5, DIG. 2; 299/56, 57

[56] References Cited

UNITED STATES PATENTS

| | | | |
|---|---|---|---|
| 2,846,093 | 8/1958 | Densmore | 175/85 |
| 3,083,955 | 4/1963 | Compton | 175/85 |
| 3,278,236 | 10/1966 | Adams et al. | 175/85 |
| 3,663,062 | 5/1972 | Young et al. | 175/91 |
| 3,912,025 | 10/1975 | Deeter et al. | 175/91 |
| 3,918,536 | 11/1975 | Deeter et al. | 175/85 |

*Primary Examiner*—James A. Leppink
*Attorney, Agent, or Firm*—Bosworth, Sessions & McCoy

[57] ABSTRACT

Auger apparatus, such as a coal mining machine, adapted to utilize one or more augers each formed of a string of auger sections, and comprising means for transferring auger sections into the string in the proper axial, transverse and rotational position for coupling into the string. The disclosed machine comprises hoist apparatus for hoisting one or more auger sections to lift them from a storage rack at a side of the machine and place each in an auger string in the machine or to remove each from the auger string and place it in the storage rack. The hoist apparatus comprises rails extending transversely of and above the augers in the machine, a bridge that travels on the rails, a trolley that travels transversely of and on the bridge, and a lift member on the trolley movable in an upright path fixed relative to the trolley. The lift member has tong means that may be adapted to grasp one auger section, or that may be adjusted as to number and spacing to grasp simultaneously a plurality of auger sections in predetermined spaced parallel relation, so that each auger section may be placed in the machine and properly positioned to locate the section accurately longitudinally and transversely in the machine substantially coaxially with a drive chuck and a forwardly positioned auger section. The auger section has locating shoulders engageable by the tongs to locate the auger section accurately angularly or rotationally as it is being carried by the tongs, so that as the auger section is placed in the machine, it is located properly rotationally as well as coaxially, to enable it to be automatically connected in driving relation to its drive chuck and to a forwardly positioned auger section that is to be rotated.

21 Claims, 15 Drawing Figures

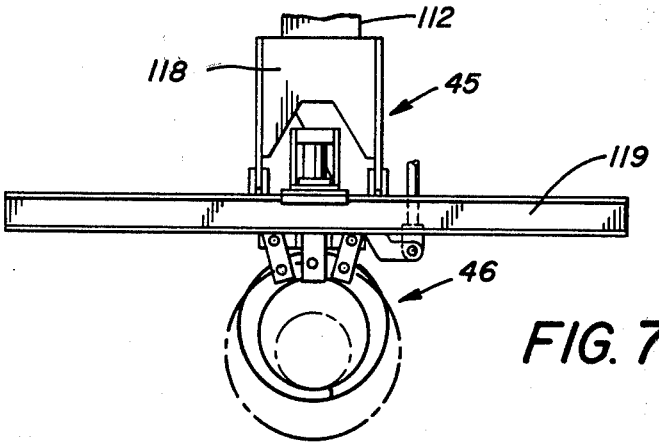
FIG. 7
FIG. 8
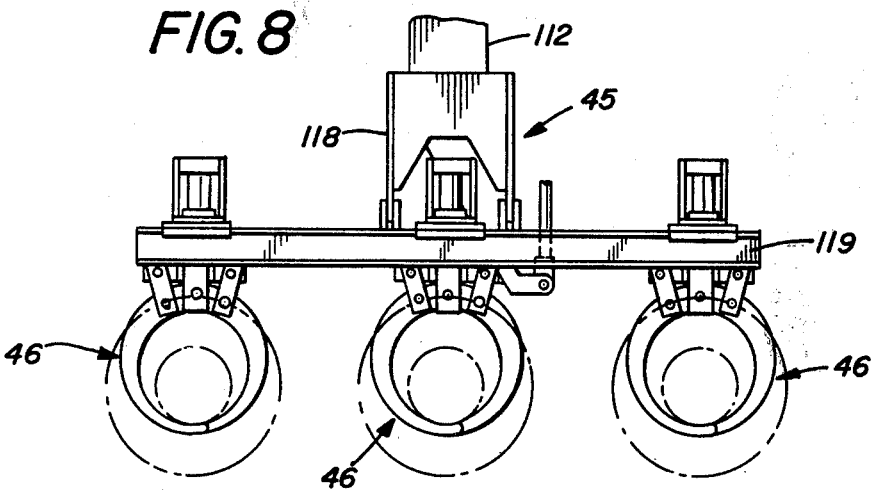

AUGER SECTION POSITIONING MEANS

FIELD OF THE INVENTION

The invention relates to auger apparatus of the type that bores one or more deep holes by an auger formed of a string of endwise connection auger sections, and more particularly to such auger apparatus providing increases speed, efficiency, and personnel safety in the handling of the auger sections.

The invention provides exceptional advantages when employed in auger mining machines, of the type adapted to be positioned adjacent an upwardly extending wall to recover coal from a seam that is exposed in such wall and extends generally laterally into the earth. Therefore, for convenience, the invention will be discussed in connection with such a machine, although it may be applicable to other types of auger apparatus.

Auger mining machines of this type comprise one or more augers each embodying a cutting head suitable to the thickness of the coal seam, connected to and rotationally driven by a string of helically vaned auger sections driven from the machine. The cutting head penetrates the coal seam, and the mined coal is transported rearwardly from the cutting head along the vaned auger string to the entrance of the hole cut by the cutting head, where the coal is collected and removed. As the cutting head is caused to penetrate into the hole, it is necessary to introduce auger sections into the string until the desired depth of the auger string is reached to achieve the desired depth of hole. After the cutting head has penetrated the desired depth of hole, it is necessary to withdraw it by removing auger sections until the cutting head is out of the hole. The machine as a whole then may be moved laterally to another position where its cutting head or heads driven by one or more augers can drill another hole or holes generally parallel to the previously drilled hole.

In order to achieve desired high production, it is necessary rapidly and accurately to handle the auger sections in taking them from a store of sections and placing them in the auger string and in then removing them from the auger string and placing them in a store of sections. The auger sections are quite heavy, often weighing several hundred pounds or more, particularly when of large diameter. It is desirable that the sections be rapidly lifted and put in place accurately longitudinally and rotationally in the auger string to enable them to be connected, preferably automatically, to the driving means on the auger machine and to other auger sections of the string when auger sections are being placed in the string; and also to be placed accurately in the store of auger sections after the auger sections are disconnected preferably automatically by remote control from the driving means and from other auger sections.

Moreover, when more than one auger string is being driven by the auger machine, it is desirable, to save time, simultaneously to handle several corresponding auger sections for all strings either in placing them in the auger strings or removing them from the auger strings and placing them in the store.

Because of the size and weight of the auger sections, they must be handled by mechanical hoist means. The hoist means preferably should be such that it can carry out the above functions with safety to the operator. It is necessary for the operator closely to observe the position of the auger section or sections being handled by the hoist means while controlling the hoist means to handle the sections rapidly and accurately, while permitting the operator to remain in a safe place free of any danger of being struck by an auger section being moved by the hoist means.

Furthermore, heretofore it has been usually necessary to use at least two operators in moving auger sections, one operator controlling handling of auger sections between an auger string in the machine and a store of auger sections as in a rack at one side of the machine, and the other operator controlling handling of auger sections between the auger string and a store of auger sections as in a rack at the other side of the machine. However, for economic operation, it is desirable that only one operator be used to perform these functions.

To achieve the above desierata, it is important that in addition to being accurately located so it is positioned in proper longitudinal and coaxial relation with the drive chuck and other auger sections in the string, each auger section being placed in an auger string be positively accurately located angularly or rotationally to permit it to be properly connected in rotational driving relation with a corresponding drive chuck on the auger machine and with another auger section being driven by such placed auger section. Otherwise, it often is necessary for an operator to manually rotationally adjust the auger section to permit it to be connected to the drive chuck and other auger in the string. This not only takes time, but can cause danger to or excessive physical strain on such operator. These problems are greatly increased when the auger hoist means is set up to place two or more parallel auger sections side by side in an equal number of auger strings. In such case another operator is often required to save time, in the absence of the present invention.

SUMMARY OF THE INVENTION

It is an object of the invention to provide auger apparatus that can satisfy the desired aspects set forth above.

It is another object of the invention to provide auger apparatus embodying as many as desired of the features summarized above, including apparatus providing all of such features. It is a further object of the invention to provide auger apparatus comprising hoist means adapted to lift and move one auger section, or a plurality of auger sections, simultaneously from an auger store to one or more auger strings, or from one or more auger strings to an auger store, such hoist means and each such lifted auger section cooperating to accurately locate the auger section longitudinally and transversely and coaxially with respect to the auger string and driving chuck of the auger machine and provide positive automatic rotational adjustment if needed, of the auger section as it is being carried by the hoist means, to permit the auger section to be automatically connected in driving engagement with the corresponding drive chuck and forward auger section in the auger string.

BRIEF DESCRIPTION OF THE DRAWINGS

The above advantages, features and objects will become more clearly apparent from the following description of the preferred embodiments of the invention in connection with the accompanying drawings in which.

Figure 1:
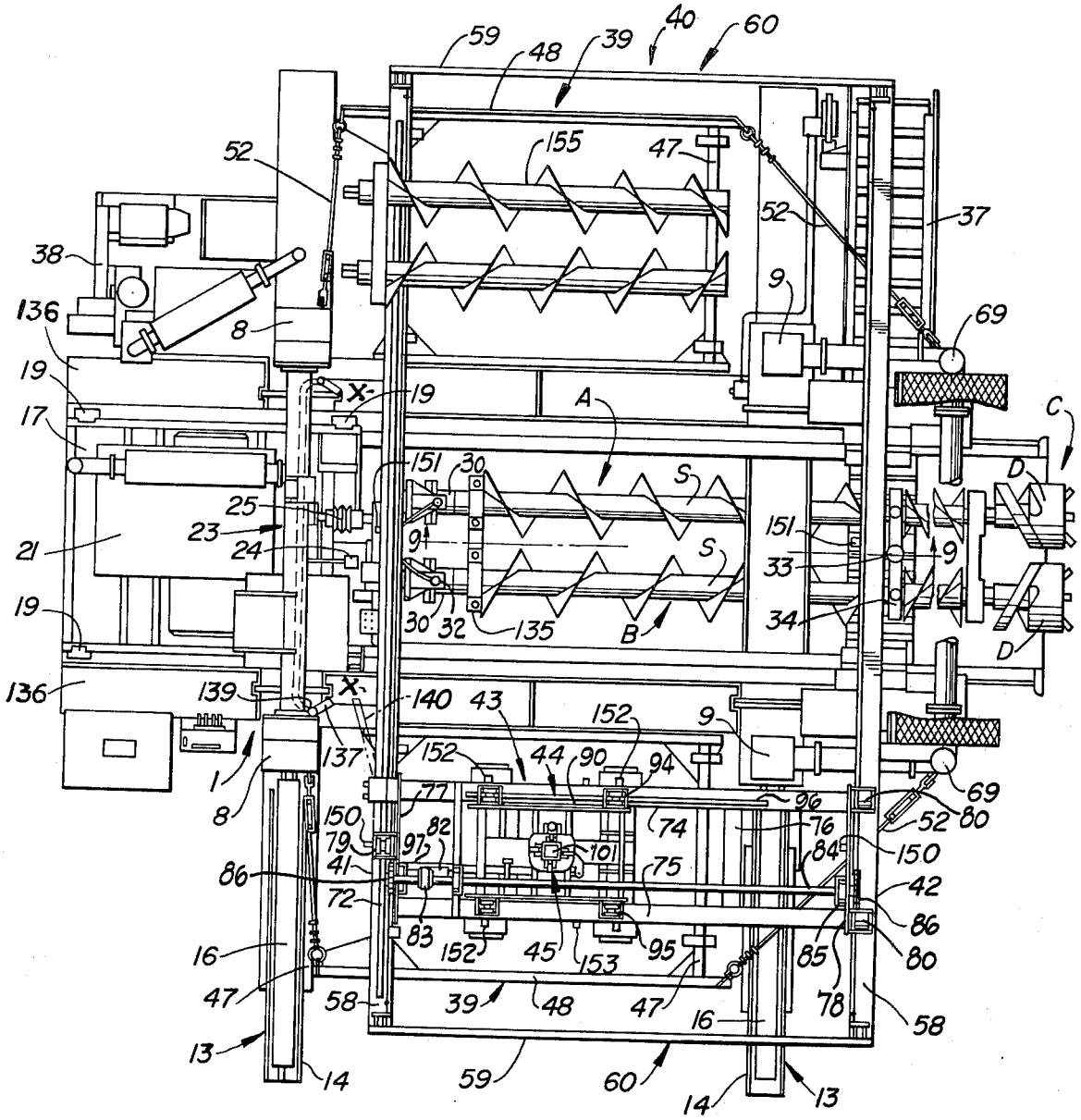
FIG. 1 is a plan of apparatus embodying the invention comprising an auger mining machine useful for mining coal in seams, having two auger strings with two cutting heads, connected to a single power source, and having auger section hoist means.
Figure 5:
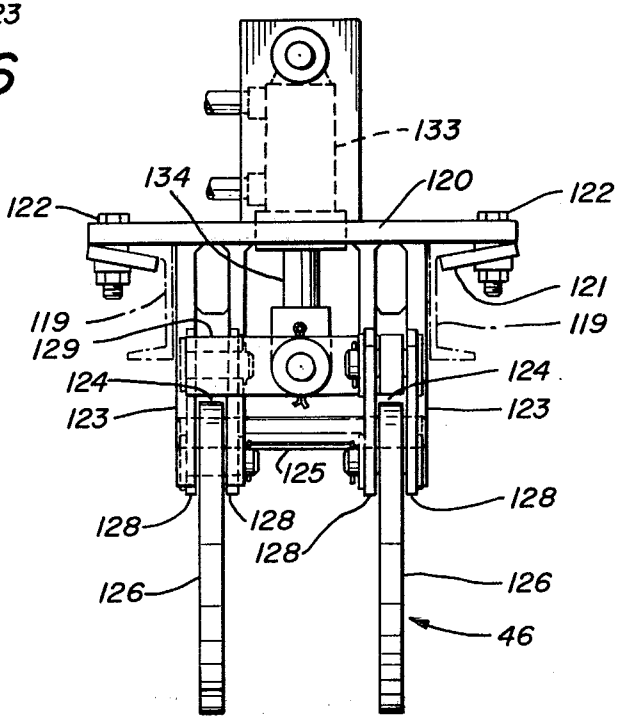
Figure 6:
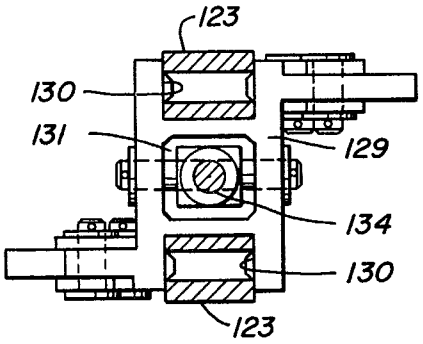
Figure 4:
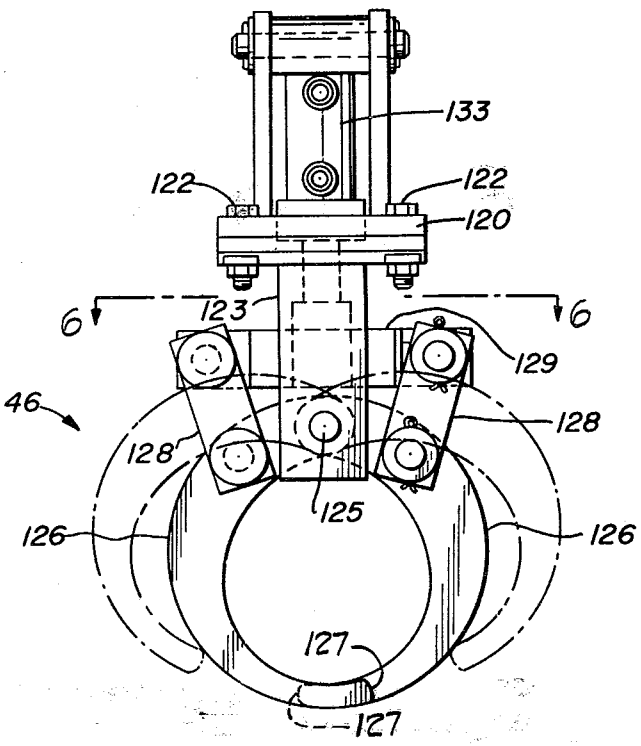
Figures 9, 10, 11, 12, 13:
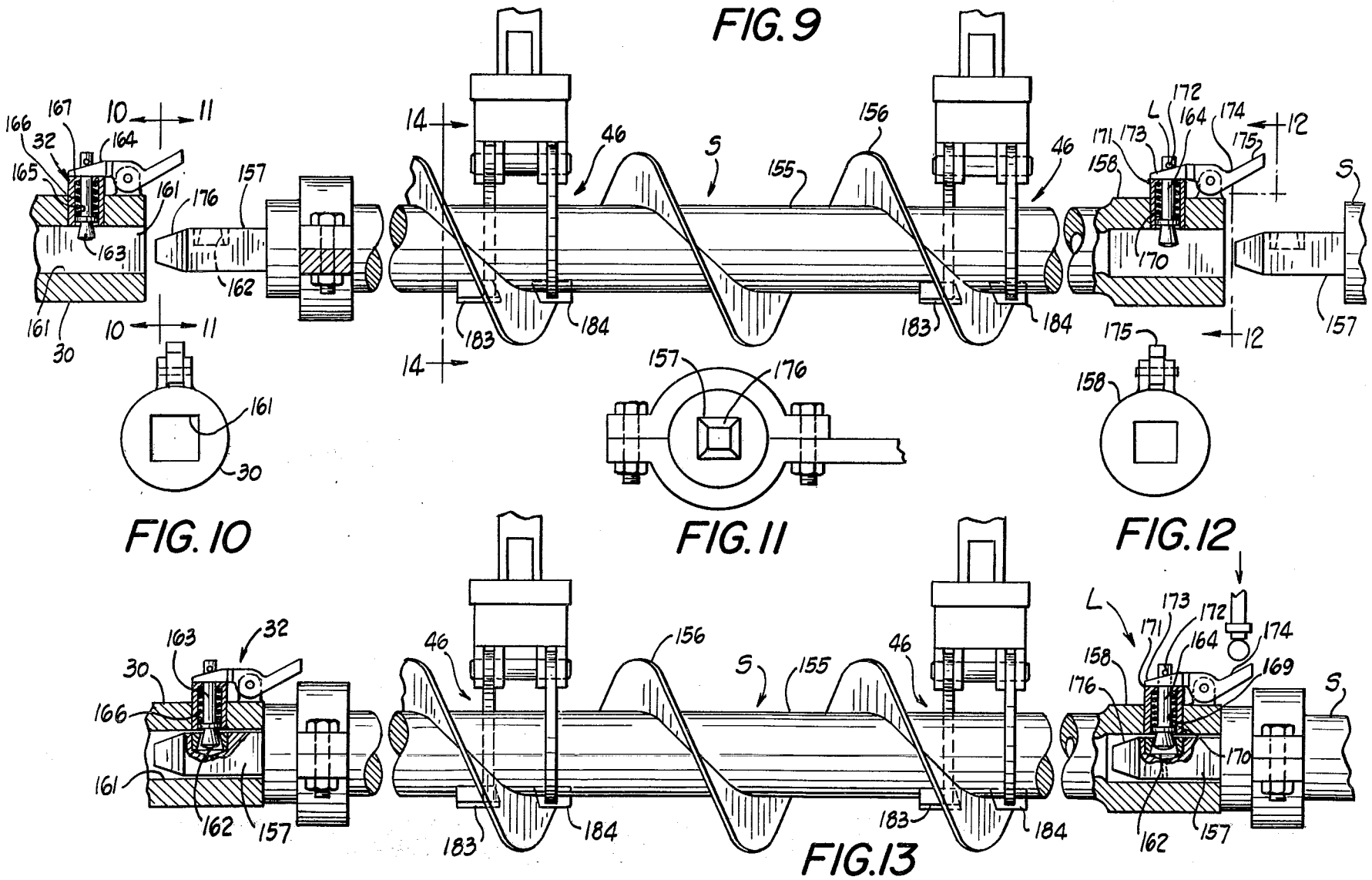
Figure 14:
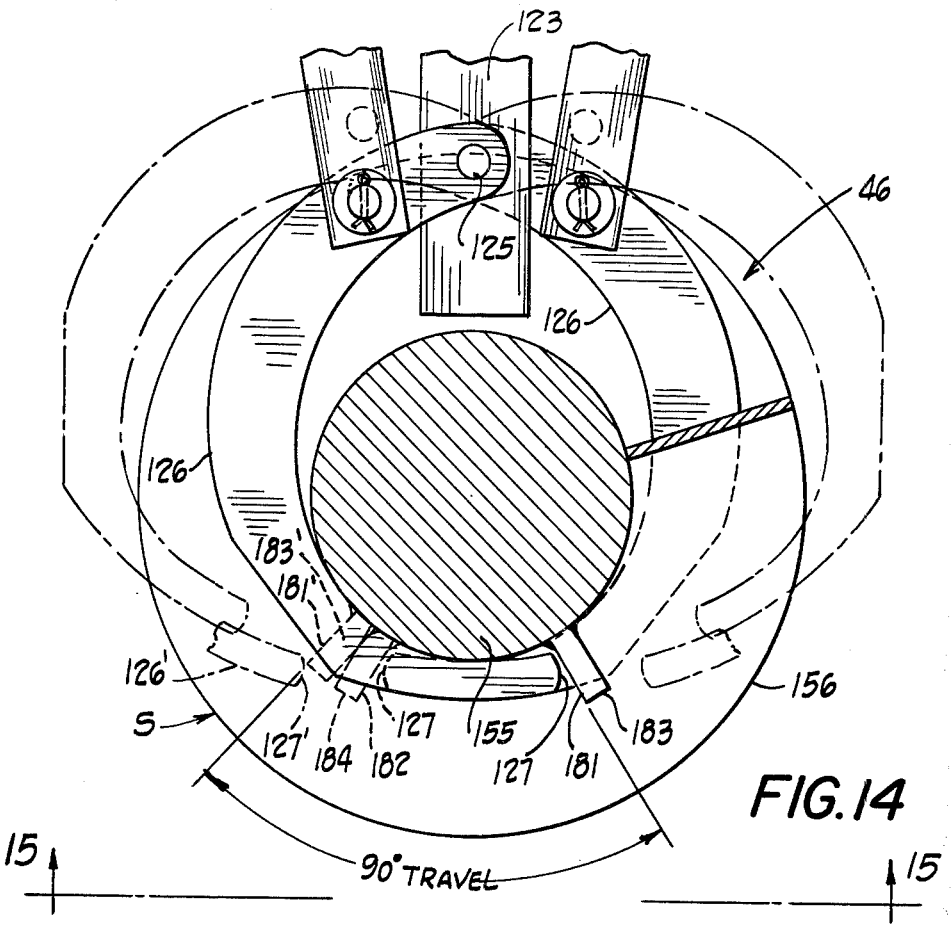

FGG. 4 is an end view of one of the auger grasping tongs of the hoist means, showing the tong fingers in full lines in the closed position and in broken lines in the open position, this figure being to a larger scale than the preceding figures;

FIG. 5 is a side view of the tong of FIG. 4;

FIG. 6 is a section along line 6—6 of FIG. 4;

FIG. 7 is a fragmentary view showing how the hoist means can be adapted to carry a single auger section;

FIG. 8 is a fragmentary view showing how the hoist means can be adapted to carry three auger sections;

FIG. 9 is a view to an enlarged scale with parts broken away showing an auger section and tong means for carrying the auger section embodying the invention, the auger section being viewed as from line 9-9 of FIG. 1 and properly aligned with the drive chuck and a forwardly positioned auger section for automatic connection;

FIG. 10 is a view from line 10—10 of FIG. 9, showing the end of the drive chuck;

FIG. 11 is a view from line 11—11 of FIG. 9, showing the shank end of the auger section;

FIG. 12 is a view from line 12—12 of FIG. 9, showing the socket end of the auger section;

FIG. 13 is a view based on FIG. 4 and to the same scale, showing the auger section connected in driving relation to its drive chuck and the next forwardly positioned auger section in the auger string;

FIG. 14 is a section to an enlarged scale along line 14—14 of FIG. 9; and

Figure 15:
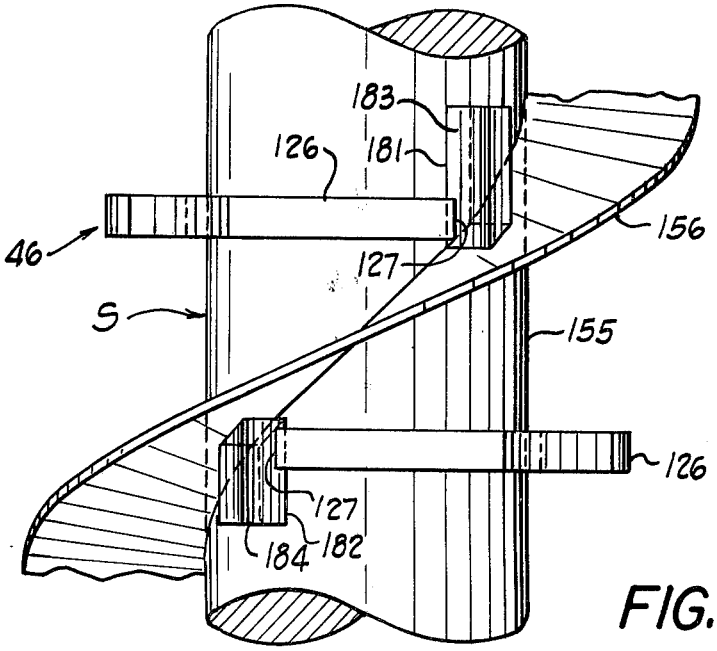

FIG. 15 is a view from line 15—15 of FIG. 14.

DESCRIPTION OF THE PREFERRED EMBODIMENT

The auger machine as a whole of FIGS. 1 to 6 for illustrative purposes is similar to that of copending United States patent application Ser. No. 398,971, filed Sept. 20, 1973, of Ronald C. Deeter and the present applicant. The machine comprises a rigid main frame 1 which supports in part and drives two augers A and B. The auger are detachably connected at their outer ends to a cutting head assembly C and are made up of strings of connected identical auger sections S between the cutting head assembly and the auger machine. The cutting head assembly C shown is similar to that of FIG. 11 of U.S. Pat. No. 3,663,062 of May 16, 1972, and comprises a rigid frame rotatably supporting two cutting heads D that are driven by augers A and B. Other types of cutting head assemblies may be used such as those of FIG. 4 or other figures of U.S. Pat. No. 3,663,062. The disclosures of U.S. Pat. No. 3,663,062 and of the above identified copending application are incorporated herein by reference.

Figure 3:
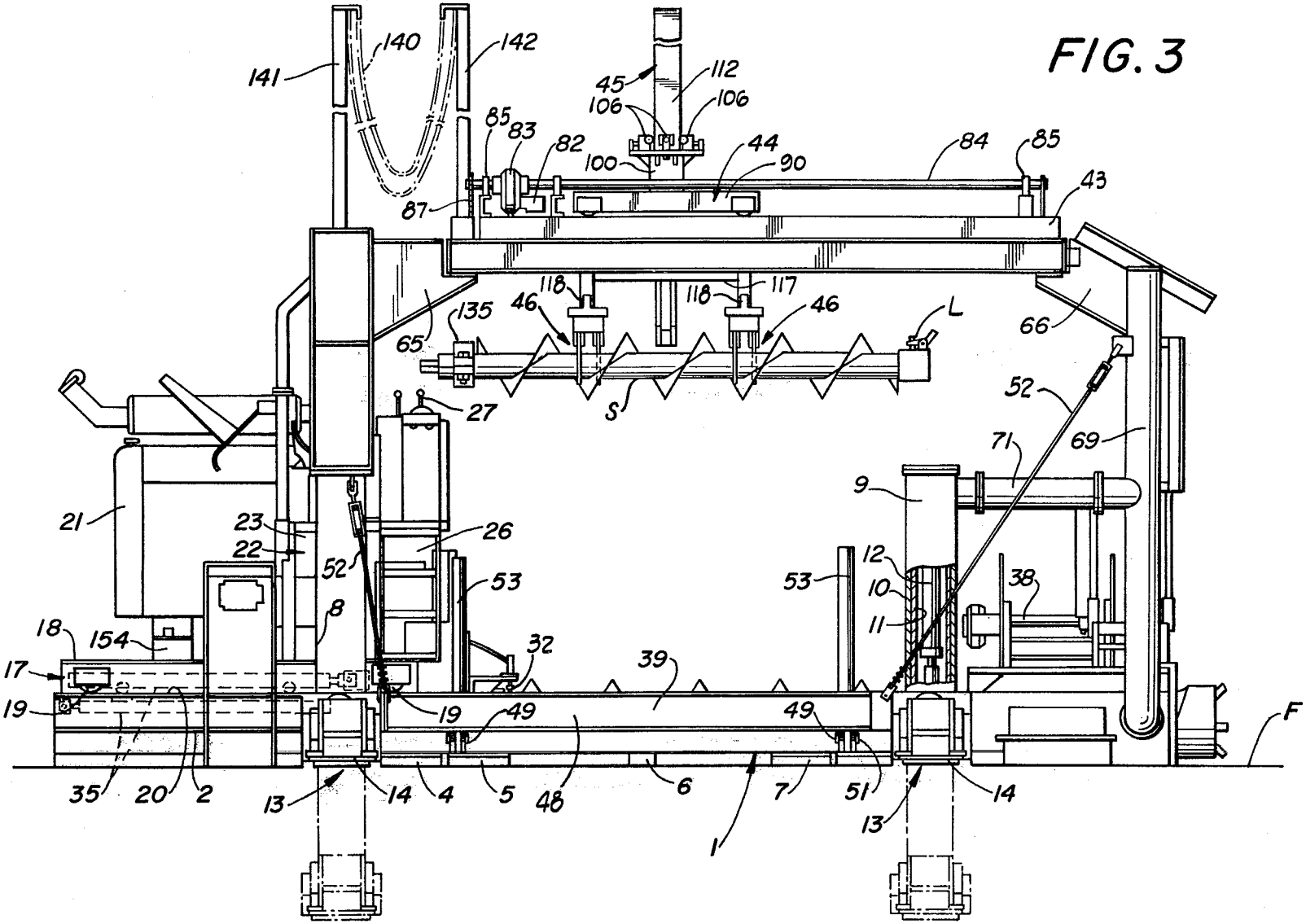
FIG. 3 is a side elevation of the machine to the scale of FIG. 2, showing an auger section being carried between the storage rack and the auger string, and indicating in broken lines the jacks extended to raise the apparatus.

Main frame 1 comprises a pair of spaced longitudinally extending massive parallel frame beams 2 and 3 rigidly joined by cross members 4–7 (FIG. 3). Near its ends and in corresponding positions on either side, the main frame has four vertical jacks 8, 9 each comprising a vertical tubular member 10 fixed to frame 1 and having a telescoping inner member 11 adapted to be moved downwardly and upwardly into member 10 by fluid cylinder 12 to raise or lower frame 1 as required. The lower ends of members 11 of the pairs of jacks 8, 9 at each end of the machine carry a skid assembly 13 comprising a skid 14 adapted to rest on the floor F and known hydraulic cylinder means 16 for causing relative movement between the members 11 and the skid longitudinally of the skid and laterally of frame 1. The jacks 8, 9 can lift the main frame and the portions of the machine carried by it free of the ground and the skid assemblies permit the frame and such portions to be moved laterally. By suitable manipulation of the jacks and skids in known manners, it is possible to move the machine laterally or closer to or further from the wall into which the augers penetrate, as desired.

Frame 1 also supports a carriage 17 for guided movement longitudinally on beams 2 and 3, between an extreme rearward position shown in full lines in FIG. 3, to a forward position. This is to advance the augers A and B and cutting heads for cutting, and to retract them for removal of the auger sections S, or to retract the carriage without the augers for insertion of additional auger sections to lengthen the augers A and B in a known manner. Carriage 17 comprises a rigid frame 18 having wheels 19 (FIGS. 1, 3) that ride on guide portions 20 of beams 2, 3.

An internal combustion engine 21 constituting the power source for rotating the augers is fixed on carriage 17 and drives through main power train means 22 comprising a clutch 23 having control lever 24, a flexible coupling 25, a shiftable transmission 26 having shift lever 27, and a main gear box 28, two auxiliary power train means taking the form of gear boxes 29 that rotate two drive chucks 30. An operator on a seat 31 on carriage 17 can manipulate the engine throttle controls, the clutch and shift levers and known controls for operating known latching means 32 for automatically unlocking auger sections from the drive chucks 30. The apparatus also includes known latching means similar to that disclosed in U.S. Pat. No. 3,278,236 comprising a fluid cylinder 33 that can move bar 34 to engage latches L on the auger sections S to disconnect auger sections S that are connected endwise together in an auger string forming auger A or B.

The carriage is moved between its rear and forward positions by fluid cylinder actuating means 35.

The frame 1 includes a belly plate 36, between and supported from beams 2 and 3 by cross members 4–7, that support those auger sections S in the machine extending from drive chucks 30 to the front end of the machine at the wall into which the augers penetrate. Coal mined by the cutting heads and augers passes onto a conveyor 37 carried by the main frame near the front of the machine. The apparatus also includes auxiliary power means 38 (FIG. 1), comprising an internal combustion engine and appurtenant apparatus, for providing pumped hydraulic fluid under pressure which through known means is controlled to actuate various other portions of the apparatus such as the jacks, the skids, the conveyor, and the hoist apparatus to be later described.

The machine of FIGS. 1 to 3 positively rotates through drive chucks 30 the auger cutting heads D by rotation of the two augers A and B as will be described later. As the cutting heads are rotated and caused to penetrate the coal by movement of carriage 17, auger sections S from the storage racks 39 are inserted adjacent the drive chucks 30 when the carriage 17 is located in its rear positions on frame 1, to extend the lengths of augers A and B as required as the holes are bored deeper by the cutters, A hoist apparatus 40 for handling auger sections is supported from the main frame 1, and comprises two spaced parallel rails 41, 42 extending transversely over the racks 39 and over the central portion of the auger machine in which are located auger sections S included in augers A and B. A bridge 43 is adapted to travel on rails 41, 42. A trolley 44 is adapted to travel on the bridge 43 transversely of rails 41, 42. The trolley 44 carries a lift member 45 that is movable upwardly and downwardly relative to the trolley and that carries tongs 46 adapted to grasp simultaneously a pair of auger sections S and move them from either of storage racks 39 to the desired positions in the machine where they can be connected to the driving heads 32 and to other auger sections, or to move them from such positions to racks 39.

Each storage rack 39 (FIGS. 1–3) comprises two side beams 47 rigidly connected together by end beams 48, and pivotally connected at their inner ends to frame 1 of the machine by removable pins 51. The outer ends of the racks are supported by cables 52 from the machine. The racks therefore can be removed, or swung upwardly, to reduce the width of the machine for moving to a different location. Upright posts 53 are demountably adjustably fixed to beams 47 of each rack to hold auger sections of different diameters on the rack.

In the illustrated apparatus, each rail 41, 42 comprises a central portion 57 and two end portions 58. The end portions at each side of the machine are rigidly connected by a member 59 to form a rigid movable rail structure 60 connected by hinges 61 to the central portions of the rails and adapted to be firmly held in its lateral or extended position (FIG. 2) by bolts 62 through flanges 63 and 64 on the central and side portions of the rails. By removal of the bolts, the rail structures 60 can be caused to hang downwardly to reduce the width of the machine for moving.

Rail 41 is supported by brackets 65 fixed to the central portion of the rail and mounted on rear jacks 8. The other rail 42 is supported from brackets 66 fixed to the central portion of the rail and mounted on upwardly extending front posts 69 the lower ends of which are fixed to the main frame 1 of the apparatus; intermediate cross members 71 connect posts 59 to the associated front jacks 9, to aid in rigidly holding the posts firmly in place.

Rail 42 has a track 72 (FIGS. 1, 2) to guide bridge 43 along the rails. The outer end portions 58 of rails 41, 42 carry stops 73 to limit the travel of bridge 43.

Bridge 43 comprises two beams 74, 75 extending between rails 41, 42 and rigidly connected to intermediate cross members 76 and end cross members 77 and 78 fixed to the ends of beams 74, 75. At one end of the bridge cross member 77 carries a roller 79 riding on rail 41 and engaging guide track 72. At the other end of the bridge, cross members 78 carries two rollers 80 that ride on rail 42. The bridge is thus stable because of the three-point support even though the rails may not be exactly level with respect to each other.

The bridge is moved either direction as required along rails 41, 42 by a fluid power motor 82 that drives through a gear box 83 a shaft 84 that extends along the bridge above trolley 44. Shaft 84 is rotatably carried by bearing brackets 85 on members 77, 78, and has a drive sprocket 86 at each end.

The top of each beam 41, 42 (FIGS. 1, 3) supports a chain 87 fixed at its ends to stops 73. Each chain is long enough to extend for substantially the full distance between stops 73 and also upwardly around and between idler sprockets 88 fixed to the ends of the bridge and over a drive sprocket 86. Consequently as shaft 84 is rotated in a desired direction by fluid motor 82, the bridge is moved in the desired direction by engagement of its sprockets 86 with chains 87. Such movement is positive at both ends of the bridge, so there is no tendency for the bridge to twist out of alignment relative to the rails.

The trolley (FIGS. 1, 2, 3) comprises a frame 90 that is a rigid, strong structure and is supported for movement on and along bridge beams 74, 75 by rollers 94 and 95 rotatably supported from the corners of frame 90, at least two of the rollers on one side engaging a guide 96 fixed to a beam to guide the trolley in a straight path.

The trolley is moved longitudinally of the bridge by a fluid cylinder 97 connected to the bridge and having a piston rod connected to the trolley. The trolley carries an upwardly extending sleeve 100 that is rigidly mounted centrally on the trolley frame 90 and has an opening 101 of polygonal cross section, square in the illustrated case, through which passes lift member 45. At its upper and lower ends sleeve 100 adjustably carries (FIGS. 1, 2, 3) rotatable guide rollers 106.

Member 45 has an upwardly extending leg 112 of a polygonal cross section similar to but smaller than the cross section of sleeve opening 101. Leg 112 is guided by contact of rollers 106 with its flat outer sides to move non-rotatably in the sleeve in an essentially upright path or axis fixed relative to trolley frame 90. Lift member 45 is moved upwardly and downwardly in such path as required by a fluid cylinder 113 mounted on the trolley and having a downwardly extending piston rod 114 connected to a bracket 115 at the lower end of the leg.

The lower end of the leg also rigidly carries a structure 116 on which a desired number of tongs 46 may be mounted in various spacings relative to each other. In the embodiment of FIGS. 1-3 there are four tong units mounted on the structure 116 in two pairs that are aligned longitudinally of the machine so that the lift member 45 can simultaneously carry two auger sections S in predetermined parallel relation, without twisting about the upright axis of lift member 45. Structure 116 comprises lateral member 117 extending longitudinally of the machine and rigidly fixed to the leg and rigidly carrying spaced downwardly extending portions 118 to which are fixed members 119 extending transversely of the machine. Members 119 are arranged in pairs so that each pair can demountably and adjustably support one or more tongs.

Each tong (FIGS. 4–6) comprises a generally horizontally extending plate member 120 having near its edges strips 121 clamped by bolts and nuts 122 to the flanges of each pair of members 119. Each member 120 carries inside of the members 119 two rigid parallel downwardly extending members 123 each having a slot 124 at its bottom. A pin 125 extends through and pivotally supports a pair of tong fingers 126 in the slots 124 of each member 123. The fingers of each tong are oppositely disposed and laterally offset relative to each other; and each tong finger is shaped in the form of a hook with a lower end portion 127 extending toward the other tong finger, so that when the fingers are in the closed position relative to each other, their end portions 127 overlap as shown in full and dotted lines in FIG. 4, and when they are retracted to their widest open position their end portions are separated by a substantial distance, as shown in broken lines, sufficient to clear the central portion of the auger section between its vanes.

The tong fingers are moved thus between their closed and open positions by links 128 pivotally connected to each of the fingers and to a slidable member 129 that can move vertically between members 123. Member 129 has oppositely disposed slots 130 that slidably fit around a vertical side and two vertical edges of each member 123 to guide member 129 vertically and to prevent it from twisting or jamming under load. Member 129 also has a central opening 131. Member 129 also has a central opening 131. Member 129 is moved upwardly and downwardly as required to open and close the tong fingers by a double acting fluid actuated cylinder 133 pivotally connected to and above the top member 120 and having a piston rod 134 extending through member 120 and connected to slidable member 129 in its opening 131. As is apparent from FIGS. 4–6, when cylinder 133 retracts the piston rod, slidable member 129 moves up and links 128 pull up on the fingers 126 of each tong 46 so they pivot around pin 125 and retract to their open position. When cylinder 133 moves slidable member 129 down, the tong fingers pivot around pin 125 and move downwardly to their closed position, aided by gravity.

As is apparent from FIG. 3, the tongs on members 118 are arranged in alignment longitudinally of the machine, so there are two tongs that grasp one of the auger sections around its central portion between its vanes and properly align it longitudinally of the machine. In the embodiment of FIGS. 1–6, in which two parallel auger sections are handled simultaneously, the spacing between the pairs of tongs is such that auger sections carried by the tongs are properly spaced to be put in augers A and B. Preferably a tie bar 135 (FIGS. 1, 2, 3) is rotatably connected to each pair, or to a substantial number of pairs, of adjacent auger sections, near at least one end of the pair, to aid in maintaining proper spacing of the sections during the drilling operation and during handling and storage of the sections.

Figure 2:
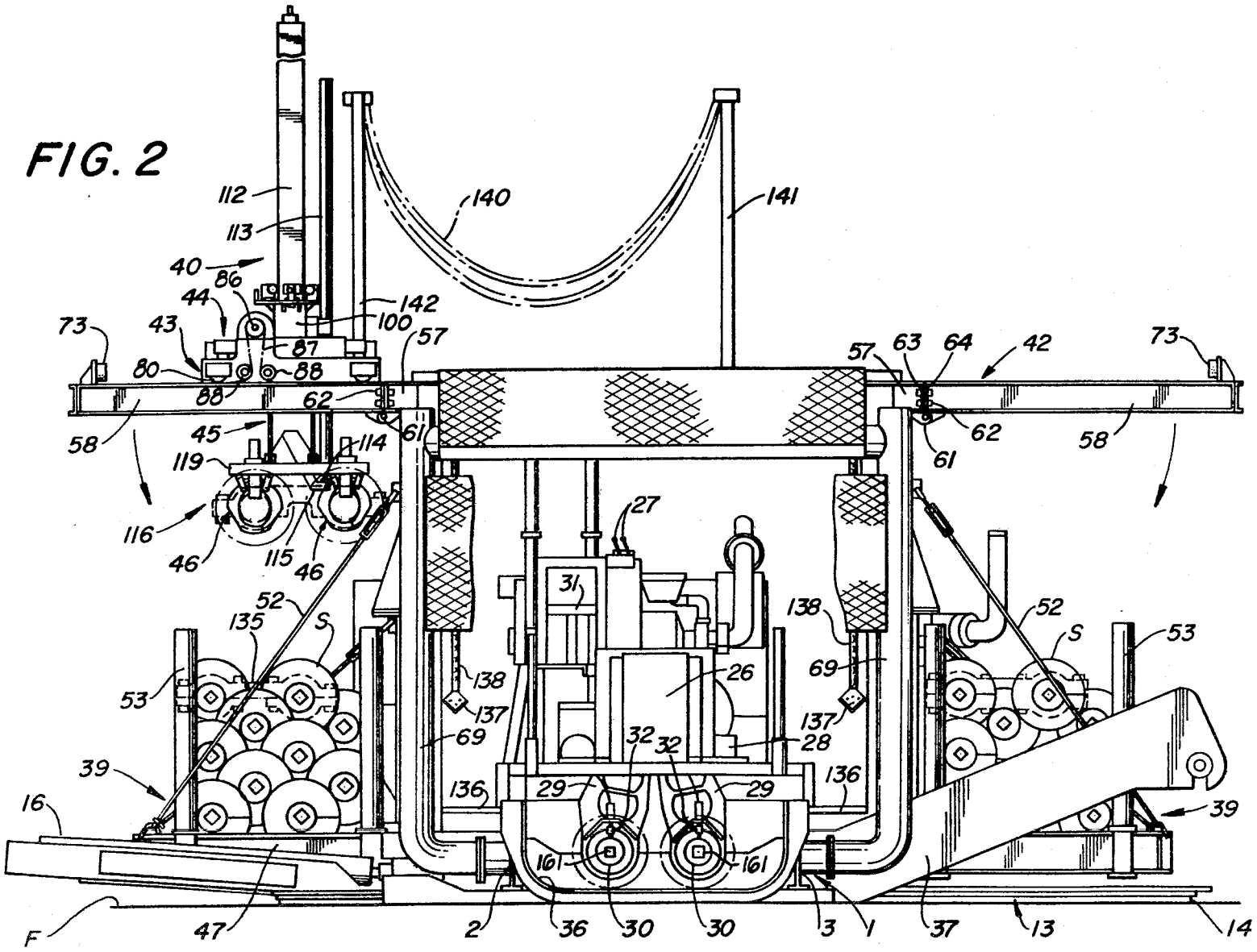
FIG. 2 is a front elevation of the machine of FIG. 1 and to a larger scale, the cutting heads being omitted and the auger sections being shown in broken lines.

As is also apparent from FIGS. 2, 7, 8, the illustrated apparatus is adapted to carry one, two, three or even more auger sections at various spacings to compensate for various numbers and diameters of auger sections, by proper positioning of a proper number of tongs which may be readily put in place, removed or adjustably spaced by means of the above described clamping means. The hoist apparatus can therefore be advantageously adjusted to handle simultaneously the auger sections for varying numbers of auger strings.

The hoist apparatus of the machine of FIGS. 1–6 is controlled from either of two stations X on opposite sides of the machine, by an operator, who can stand on either of the walkways 136 extending longitudinally along opposite sides of the machine, using suitable pendant control means 137 (FIG. 3) at each station X, connected by suitable known electrical circuits through flexible cables 138, 139, 140 supported in part by masts 141, 142 on the frame of the machine and the trolley, that supply electrical power from a suitable source not shown on the machine and control operation of the fluid actuated motor 82 that moves bridge 43, fluid actuated cylinder 97 that moves the trolley 44, and the fluid actuated cylinder 113 that moves the lift member 45 in its upward and downward path.

An operator at either of the positions X is completely safe and out of any location where he can be struck by an auger section as it is being moved between an auger rack and the operating position or vice versa. Moreover, an operator in the seat 31 controlling rotation of the augers can also operate the nearest pendant control means, so one-man control of the entire machine, including handling of auger sections is possible.

Assuming two auger sections are to be simultaneously handled, operation of the illustrated hoist apparatus for moving the pair of auger sections simultaneously from one of the storage racks to positions in the auger string may be as follows. The pendant control means 137 at one of the locations X is actuated to move the trolley and bridge and to open the four tongs 46 on the lift member 45, then to lower the lift member while properly aligning the tongs at the proper locations on two selected auger sections in one of the storage racks 39. The tongs are then closed and the lift member is raised sufficiently to cause the auger sections to clear the top of the adjacent jack 9. The trolley is then moved forward on the bridge to move the auger sections forward to approximate transverse alignment with positions in which they are to occupy in the auger strings the bridge is then moved on rails 41, 42 to cause the auger sections to be approximately laterally aligned above the auger strings after which the lift member is lowered to lower the auger sections until they are actually or very close to their final positions. If necessary, final adjustments of the positioning of the auger sections can be made by visual observations and operation of the pendant control means so that each auger section is longitudinally, transversely and coaxially aligned with its drive head 30 and forwardly positioned auger section, in the position which it is to occupy. Thereafter, assuming that the auger sections are properly angularly or rotationally positioned relative to their corresponding drive chucks 30 and forwardly located auger sections, the operator can cause the carriage 17 to move forwardly to cause the locking means 32 to lock the two auger sections to the drive chucks 30 and then further move the carriage 17 and these auger sections forwardly until these auger sections engage with and lock onto the auger sections of the strings extending forwardly from the machine, the latch means L acting to lock the sections. The apparatus is then ready to be operated to bore mining holes.

When it is desired to remove auger sections from the auger strings, as when auger strings are removed from the drilled holes, the reverse operation is followed. The bridge 43 and the trolley 44 on the bridge are moved so that the auger tongs 46 are properly aligned in relation to the augers to grasp the auger sections by their central portions, the lift member 45 is lowered, the final adjustments and alignments are made, and the tongs actuated to grasp the auger sections. Before or after this operation, both ends of each auger section to be removed are disconnected first by actuation of the unlatching means 34 to operate the latching means L disconnect the auger sections from the other forwardly positioned auger sections in the strings, and then by actuation of the means 32 to disconnect the auger sections from the drive checks 30, the carriage 17 being moved rearwardly to accomplish disconnection.

After the tongs are actuated to close and grasp the disconnected auger sections, the lift member 45 actuated by operation of a pendant control means 137 to lift the auger sections to a position where they will clear the top of adjacent jack 9, then to move the auger sections laterally and rearwardly to the proper location on the selected auger storage rack on which they are then deposited by moving the lift downwardly.

Locating indicia are provided by which by visual observation the bridge and trolley can be rapidly and properly located transversely so that the tongs on the lift member of the trolley can properly located relatively to the positions of the auger section or sections in the aguer strings in the apparatus. As shown in FIG. 2, pointers 150 on the bridge and markers 151 on the rails of the apparatus are located so that they are aligned when the bridge is properly positioned over the auger sections in the machine and so at least one set of cooperating indicia can be seen by an operator at either of stations X or seat 31. Pointers 152 on the trolley and markers 153 on the bridge are also provided to permit proper location of the trolley on the bridge by visual observation.

The present invention provides means whereby the tongs carrying each auger section, and such auger section, cooperate to insure that the auger section is properly angularly or rotationally positioned to insure that, when the auger section is properly located transversely and longitudinally as described above, it can properly engage and be connected to its corresponding drive head 30 and to its corresponding forwardly positioned auger section in the string, to enable rapid automatic latching of the auger section to both the drive head and the forwardly located auger section when the carriage is moved forward as described above and to permit proper driving and rotation of the auger section by the drive head 30.

Each auger section S (FIGS. 1, 3, 9, 11, 12, 13) comprises an elongated body 155 having an external helical vane 156 secured thereon as by welding, a shank portion 157 (FIGS. 1, 9, 11, 13) that is of polygonal, preferably square, cross section at one end of body 155, and a socket portion 158 (FIGS. 1, 9, 12, 13) having a socket recess 159 that is polygonal, preferably square, at the other or end of the body and adapted to receive a shank portion 157 (FIGS. 9,13 of the next forwardly positioned auger section S in the auger string. Each drive chuck 30 (FIGS. 2, 9, 10, 13) also has a similar recess 161 adapted to receive in slidable but non-rotatable relation the shank portion 157 of the auger section S adjacent to the drive chuck in the auger string. Thus, each auger section S in an auger string may be non-rotatably coupled in rotatable driving relation to a drive chuck and to immediately forward positioned auger section in the string, and a string of auger sections may thus be coupled together endwise so they do not rotate relatively to each other, to provide an auger which can penetrate deeply into the earth.

In known manner, shank portion 157 of each auger section S has a radially extending hole 162 into which can project a pin 163 of latching means 32 mounted on the drive chuck (FIGS. 1–3, 9, 10 and 13), or in which can project the pin 164 of latching means L mounted on the socket portion 158 of an auger section immediately forward of the auger section having the shank portion that fits into the chuck socket (FIGS. 9, 13).

Latching means 32 on the drive chuck comprises a radially extending passage 165 in which the pin 163 is mounted and adapted to move radially of the chuck, being biased inwardly toward the axis of rotation of the drive head by a spring 166 bearing on a shoulder on the pin and against a retainer 167 at the outer end of the passage. The pin 163 is adapted to be raised out of opening 162 by suitable known automatic means controlled by the operator, contacting lever 168 of means 32, to permit shank portion 157 of auger section S to be withdrawn from chuck socket recess 161 when it is desired to remove the auger section.

Latching means L on the socket portion of each auger section comprises a radially extending passage 169 in which the latch pin 164 is mounted and adapted to move radially of the auger section, being biased toward the axis of rotation of the auger section by a spring 170 bearing against a shoulder on the pin and against a retainer 171 at the outer projecting end of a sleeve 171, fixed in the socket portion, in which radial passage 169 is located. Pin 164, at its outer end, has a cross pin 172 adapted to be engaged by the bifurcated end 173 of a lever 174 that is pivotally mounted on the socket and has an operating end 175. The operating end is adapted to be forced downwardly by the unlatching means 34 when required.

Each shank portion 157 of each auger section has a tapered outer end portion 176 so that during coupling auger sections together (FIGS. 9, 13) or on coupling an auger section to a drive chuck 30, the axial movement of the shank portion into the socket recess causes the tapered end of the shank portion to move radially outwardly the end of the latch pin of the latching means 32 on the drive unit or the end of the latch pin of the latching means L of an adjacent auger section against the force of its biasing spring, until the pin becomes aligned with the latch pin hole 162 in the shank portion, when the spring of the latching means forces the latching end of the latch pin into the hole 167 to cause latching engagement of the shank portion with the socket portion of the drive chuck or of preceding auger section. Accordingly, the coupling operation results in automatic latching (FIG. 13) of the aligned auger sections and prevents their inadvertent detachment during axial movement.

It is important that each auger section not only be rotationally or angularly aligned so that its shank portion will fit into the socket recess of either the drive chuck or of another auger section, but that the auger section also be rotationally positioned so that the hole 167 in its shank portion and the pin of either latching means 32 or L be properly aligned so that the latch pin will properly engage the hole in the shank portion to lock the auger section against axial movement.

As an auger section is lifted automatically, as by the tong means described above, the auger section could in the absence of the present invention rotate in the tong means, particularly because of the momentum of the auger when the auger hoist means starts and stops. If the auger section so rotates, it may rotate so the shank means will not fit into the polygonal socket openings in which they should fit, or even rotate sufficiently so that even if the shank means does fit, the pin of the latching means will not be properly aligned with the hole 162 in the shank means. Moreover, rotation of the auger section may occur as the auger section is placed in the storage rack and nests with the auger sections there. Furthermore, as the auger section is rotated, it would tend to move axially because the helical vanes contacting the tongs could act as a screw thread, and this would introduce additional problems.

In any event, in the absence of the present invention, after the auger section was moved into place on the belly plate of the machine, and properly aligned axially and longitudinally, it could be necessary manually to rotate the auger section to properly align its shank with the socket recess of the drive unit or the adjacent auger section. This would be difficult to do manually because of the considerable weight of the auger section, and also could be dangerous because the operator might move into contact with the edges of the flights of the auger sections; and in any event such manual adjustment would be time-consuming and result in considerable loss of production time.

These problems are solved by the present invention, and the auger sections are caused to automatically be positively properly rotationally angularly positioned as they are placed in the string. In the illustrated embodiment (FIGS. 9, 13–15), each auger section has locating means, in the form of locating shoulders or surfaces 181 and 182 on bar portions 183 and 184 fixed as by welding to body 155 of the auger sections at positions between the vane flights where the shoulders can be engaged by the end portions 127 of fingers 126 of tongs 46, so that when the laterally spaced tong fingers move toward their closed overlapping positions, shoulders 181 and 182 can be contacted by the ends of the tong fingers to cause the auger section to be properly rotationally or angularly located.

If the auger section is rotationally displaced, one of these locating shoulders will be initially engaged by the end portion 127 of a tong finger, and as the tong fingers move to their fully closed position, the end of such tong finger will push, if necessary, against such locating shoulder to rotate the auger section about its axis while it is carried by the tong fingers, to properly angularly or rotationally locate the auger section. This is illustrated in FIG. 14, in which broken lines 181′ and 183′ indicate the locating surface 181 and bar 183 while they are angularly displaced from the desired angular position, and in which FIG. 126′ indicates the left hand tong finger as it is moving to its closed position, causing its end portion 127′ to contact the displaced locating shoulder 181′ and move it and its bar, and hence the auger section, to the correct predetermined angular position as shown by the full and dotted lines in FIG. 14. The tong fingers 126 of each tong, and the locating shoulders 181 and 182 of the bars 183 and 184 for each tong, are laterally offset or axially spaced along the auger section a sufficient distance so that the tong fingers do not interfere with each other or with the locating shoulder of the other tong finger as the fingers close and rotationally support the auger section.

Since there are two locating bars 183, 184 providing locating shoulders 181, 182 for the fingers of each tong, in the illustrated embodiment in which two axially spaced tongs support each auger section, there are two axially spaced sets of locating shoulders 181, 182, one for each tong, on each auger section.

Therefore, whether or not an auger section is properly angularly or rotationally positioned when its tong picks it up from the auger rack, it will become rotationally positioned as the tong fingers close. Consequently, the auger section will be in the proper angular relation to be connected to the socket of the drive chuck and to the shank of the forwardly positioned auger section, since such socket and shank, by suitable control of the halted position of the drive chuck always will be halted with the latching means 32 and latch hole 162 in the uppermost position.

No matter what number of auger sections are simultaneously being handled, by means of the present invention each of these auger sections can be simultaneously positively properly angularly located with respect to its driving head and to its forwardly positioned auger section by cooperation of its locating surface and the tongs which grasp the auger section, all of the plurality of auger sections so handled being angularly positioned in essentially the same angular position.

In the illustrated apparatus, by means of the locating shoulder on the auger sections in cooperation with the tongs, and by means of the auger hoisting mechanism disclosed above, it is possible accurately and rapidly to pick up one or more auger sections out of an auger rack and positively locate each auger section properly transversely, longitudinally, and angularly for coupling with its drive head and its forwardly positioned auger section. The illustrated hoist apparatus can accurately locate one or more laterally extending auger sections in an auger string in proper coaxial and angular relation to the drive chuck and an axially spaced forwardly positioned auger section located essentially coaxially with respect to the drive chuck, with no harmful or undesired lateral or swaying movement in any direction as can occur in hoist means in which the auger section is suspended by a cable.

One or more auger sections may also be easily disconnected from the auger string or strings, with each auger section properly rotationally positioned for ready re-insertion in the auger string as it is moved to the storage rack. Even if the auger section does tend to move rotationally slightly as it is placed in storage, such movement is not very great because it was initially put into the storage rack in the proper position before being released by the tongs.

The present invention, therefore, makes possible the positive placing of one or more auger sections in proper coaxial, longitudinal, and angular alignment with their drive means and with other auger sections coaxially aligned with the drive means, even though a plurality of auger sections are simultaneously put in place, with no danger to the operator, with no loss of time, and consequent substantially increased production and economic advantage.

While short bar portions have been shown as the locating means providing locating shoulder means or surfaces on the auger sections, and while tong means have been disclosed as included in the means for grasping the auger sections, according to the present invention other means for locating the auger sections with respect to the carrying means may be used, and means other than the illustrated tong means may be used to carry the auger sections. Furthermore, other hoisting apparatus than that disclosed may be used.

Moreover, while the auger sections and augers have been shown in the drawings as being essentially horizontal, they may be laterally positioned in positions varying from the horizontal; and the illustrated apparatus can be used to handle and locate auger sections while they are in lateral positions deviating substantially from the horizontal.

Other drive means than the drive chucks illustrated, even other auger sections, may be used.

While the invention has been shown and described with respect to specific embodiments thereof, this is intended for the purpose of illustration rather than limitation; and other variations and modifications of the specific devices herein shown and described will be apparent to those skilled in the art, all within the intended spirit and scope of the invention. Accordingly, the patent is not to be limited to the specific devices herein disclosed nor in any way that is inconsistent with the extent to which the progress of the art has been advanced by the invention.

I claim:

1. Apparatus for placing an auger section in a generally laterally extending auger string to align said auger section with, and to enable it to be connected to, drive means for the auger string and auger means essentially coaxially aligned with and axially spaced from said drive means, comprising means for grasping said auger section to support it in a generally lateral position, and locating means on said auger section adapted to be engaged by said grasping means to positively position said auger section in a predetermined angular position that permits it to be connected non-rotatably in rotatable driving relation to said drive means and said auger means when said auger section is essentially coaxially aligned with said drive means and said auger means.

2. The apparatus of claim 1 in which said means for grasping said auger section is adapted to grasp said auger section at locations spaced axially of said auger section, and means on said auger section at each of said locations adapted to be engaged by said grasping means and to cooperate with said grasping means to positively position said auger section in a predetermined angular position.

3. The apparatus of claim 1 in which said means for grasping an auger section is adapted to grasp a plurality of auger sections simultaneously, and each of said auger sections has locating means thereon adapted to be engaged by said means for grasping said auger sections to positively position each of said auger sections in a predetermined angular position.

4. The apparatus of claim 3 in which said means for grasping said auger sections and said locating means on said auger sections adapted to be engaged by said grasping means cooperate to positively position each of said auger sections in essentially the same predetermined angular position.

5. Apparatus for placing an auger section in a generally laterally extending auger string that comprises drive means and auger means essentially coaxially aligned with and axially spacd from said drive means, said drive means and said auger means having connecting means which when coaxially and angularly aligned with mating connecting means on said auger section will permit said auger section to be connected in rotatable driving relation to said auger section drive means and said auger means so said auger section does not rotate relatively to said drive means and said auger section, said apparatus comprising means for grasping said auger means and positively locating it in essentially coaxial alignment relative to said drive means and said auger means without appreciable lateral sway in any direction, and means on said means for grasping said auger section means and on said auger section cooperating to positively angularly locate said auger section relatively to said drive means and said auger means to permit engagement of said connecting means on said auger section with said connecting means on said drive means and said auger means to provide said driving engagement.

6. The apparatus of claim 5 in which said means for grasping an auger section is adapted to grasp a plurality of auger sections simultaneously and each of said auger sections has means on said auger section adapted to cooperate with said means for grasping said auger sections to so positively angularly locate said auger section relative to a drive means and an auger means adapted to be connected to said auger section.

7. The apparatus of claim 5 in which said means for grasping said auger section is adapted to grasp said auger section at locations space axially thereof, and means on said auger section at each of said axially spaced locations adapted to be engaged by said grasping means and to cooperate with said grasping means to positively position said auger section in a predetermined angular position.

8. The apparatus of claim 5 in which said means for grasping said auger section comprises tong means adapted to engage said auger section, and shoulder means on said auger section adapted to engage said tong means whereby when said tong means is in closed position said tong means engages said shoulder means and positively locates said auger section in a predetermined angular position.

9. The apparatus of claim 8 in which said tong means engages said auger section at a plurality of locations axially along said auger section and said shoulder means are at each of said axially spaced locations along said auger section and adapted to engage the tong means at said location.

10. The apparatus of claim 5 in which said means for grasping said auger section comprises a plurality of tong means adapted to engage said plurality of auger sections, and shoulder means on each of said auger sections adapted to engage said tong means, whereby when each of said tong means is in closed position said tong means engages said shoulder means on each of said auger sections and positively locates each of said auger sections in a predetermined angular position.

11. The apparatus of claim 10 in which each of said tong means engages one of said auger sections at a plurality of locations axially along said auger section and at each of said axially spaced locations along said auger section there are shoulder means adapted to engage the tong means at said location.

12. The apparatus of claim 6 in which said means for grasping said auger section and said locating means for each of said plurality of auger sections cooperate to positively angularly locate each of said plurality of auger sections in essentially the same angular position.

13. The apparatus of claim 5 in which said means for grasping said auger section comprises hoist means comprising supporting means extending above the position in which said auger section is to be located, and trolley means adapted to travel on said supporting means for movement in lateral directions transverse to and longitudinally of the axis of said drive means and said auger means, said trolley means comprising means movable in an upright path fixed with respect to said trolley means and having at the lower end of said movable means movable finger means adapted to grasp said auger section and to engage shoulder means on said auger section to positively angularly locate said auger section as said finger means close.

14. The apparatus of claim 13 in which said means movable in an upright path on said trolley means has a plurality of sets of said finger means which are adapted to simultaneously grasp a plurality of auger sections, each of said auger sections having shoulder means thereon adapted to be engaged by said finger means to positively angularly position each of said auger sections in a predetermined position.

15. The apparatus of claim 14 in which said plurality of sets of finger means and said shoulder means on said auger sections are arranged so that each of said plurality of auger sections is positively angularly positioned in the same angular position.

16. The apparatus of claim 1 in which said auger section has an elongated body portion having helical vane means thereon and shoulder means on said body portion between said vane means, and in which said means for grasping said auger section comprises movable finger means having end portions, said finger means being movable to an open position whereby said end portions are apart sufficiently to clear said body portion of said auger section and to a closed position wherein said end portions extend beneath said body portion to support said auger section, said locations of said end portions and said shoulder means being such that when said finger means are in said closed position, said end portions of said finger means engage said shoulder means and positively locate said auger section in a predetermined angular position.

17. The apparatus of claim 16 in which said means for grasping said auger section includes two sets of said finger means that are spaced axially of said auger section when said finger means support said auger section, and in which said auger section has two sets of shoulder means adapted to engage the end portions of said finger means of said sets of finger means, whereby said auger section is positively located angularly and also positively restrained against lateral movement relative to said means for grasping said auger section.

18. The apparatus of claim 16 in which said end portions of said finger means overlap each other when they are in said closed position, and in which said shoulder means on said auger section are located to be engaged by said end portions of said finger means when said finger means are in said closed position, to angularly position said auger sections.

19. The auger section of claim 18 in which said locating means comprises two sets of shoulder means which sets are axially spaced along said elongated body portion, each of said sets comprising two shoulder means that are angularly spaced around the axis of said body portion.

20. An auger section adapted to be positioned laterally in an auger machine, said auger section comprising an elongated body portion, shank means at one end of said body portion adapted to be inserted in a predetermined angular position into a socket of means adapted to be connected endwise to said auger section socket means at the other end of said body portion of said auger section having a socket adapted to be connected in a predetermined auger relation to mating shank means of a member connected endwise to said auger section, latch means on said socket means adapted to latch shank means inserted into said socket means to prevent end-wise disconnection; and locating means carried by said elongated body portion adapted to be engaged by grasping means of an auger section hoist means to locate said auger section in a predetermined angular position about its axis.

21. The auger section of claim 20 in which said locating means comprises two angularly spaced shoulder means.

* * * * *